US008914919B1

(12) United States Patent
Schubert et al.

(10) Patent No.: US 8,914,919 B1
(45) Date of Patent: Dec. 23, 2014

(54) FIXTURE USE PREVENTION SYSTEM

(71) Applicants: Jerry Schubert, Apopka, FL (US); Teresa Schubert, Apopka, FL (US)

(72) Inventors: Jerry Schubert, Apopka, FL (US); Teresa Schubert, Apopka, FL (US)

( * ) Notice: Subject to any disclaimer, the term of this patent is extended or adjusted under 35 U.S.C. 154(b) by 0 days.

(21) Appl. No.: 13/848,012

(22) Filed: Mar. 20, 2013

Related U.S. Application Data

(60) Provisional application No. 61/619,515, filed on Apr. 3, 2012.

(51) Int. Cl.
*A47K 13/00* (2006.01)
*A47K 13/24* (2006.01)

(52) U.S. Cl.
CPC ..... *A47K 13/242* (2013.01)
USPC ..... 4/253

(58) Field of Classification Search
USPC ..... 4/253
See application file for complete search history.

(56) References Cited

U.S. PATENT DOCUMENTS

| | | | | |
|---|---|---|---|---|
| 2,811,724 | A | 11/1957 | San Bernardino et al. | |
| 3,056,972 | A * | 10/1962 | Miller | 4/253 |
| 3,116,527 | A * | 1/1964 | Springer | 4/253 |
| 3,431,004 | A * | 3/1969 | Schell | 4/253 |
| 4,179,762 | A | 12/1979 | Barnhardt et al. | |
| 4,233,697 | A | 11/1980 | Cornwall | |
| 4,502,167 | A * | 3/1985 | Porzelius | 4/253 |
| 4,894,870 | A * | 1/1990 | Buckshaw et al. | 4/253 |
| 5,027,447 | A | 7/1991 | Pino | |
| 6,721,965 | B1 | 4/2004 | Alston | |
| 2007/0250997 | A1 | 11/2007 | McDonald et al. | |

* cited by examiner

*Primary Examiner* — Tuan N Nguyen
(74) *Attorney, Agent, or Firm* — RG Patent Consulting, LLC; Rachel Gilboy

(57) ABSTRACT

A device to prevent the use of newly placed toilets in buildings under construction by securing the toilet seat and toilet lid of a toilet in a fixed position to the toilet bowl. The toilet use prevention system includes a locking mechanism to secure an L-shape lid retainer and a J-shape bowl clamp in a position to prevent a toilet from being opened. Another embodiment prevents use of faucets in sinks and tubs.

19 Claims, 5 Drawing Sheets

FIXTURE USE PREVENTION SYSTEM

CROSS-REFERENCE TO RELATED APPLICATION

The present applications are related to and claims priority from prior provisional application Ser. Nos. 61/619,515 filed Apr. 3, 2012 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of devices for temporality disabling the use of toilets and other fixtures and more specifically relates to a toilet and fixture use prevention system used to prevent use during construction periods.

DESCRIPTION OF THE RELATED A

During construction of residential homes, commercial buildings, and other building projects such as shopping centers, portable outside toilets are utilized to provide site workers with convenient toilet facilities. However, as the building project continues, permanent toilets are placed in bathrooms under construction but the steps of attachment, such as plumbing, may not be completed for an extended period of time. Oftentimes, workers may choose to not exit the building project to use the portable outside toilet and will use the permanent toilets that do not have the drainage system completed. Sometimes workers may also use the permanent toilet as a place to get rid of excess paint or other debris. When these situations occur, it is necessary to clean out or perhaps replace a toilet in order to complete the plumbing work required to finish the bathroom. As a result, construction companies or contractors must take the extra time required and incur additional expense to overcome the improper use of the toilet. This is not desirable.

Various attempts have been made to solve the above-mentioned problems such as those found in U.S. Pub. No. 2007/0250997 to Andrew McDonald et al; U.S. Pat. No. 2,811,724 to San Bernardino et al; and U.S. Pat. No. 6,721,965 to Richard C. Alston; U.S. Pat. No. 4,233,697 to Kenneth R. Cornwall; U.S. Pat. No. 5,027,447 to Wilton J. Pino; and U.S. Pat. No. 4,179,762 to Kenneth O. Barnhardt et al. This prior art is representative of devices for temporality disenabling the use of toilets and fixtures. None of the above inventions and patents, taken either singly or in combination, is seen to describe the invention as claimed.

Ideally, a fixture (toilet and faucet) use prevention system should provide a device to prevent the use of newly placed fixtures in buildings under construction, and yet, would operate reliably and be manufactured at a modest expense. Thus, a need exists for a reliable fixture (toilet and faucet) use prevention system to avoid the above-mentioned problems.

BRIEF SUMMARY OF THE INVENTION

In view of the foregoing disadvantages inherent in the known devices for temporality disenabling the use of fixtures art, the present invention provides a novel toilet and faucet use prevention system. The general purpose of the present invention, which will be described subsequently in greater detail, is to provide a device to prevent the use of newly placed toilets and faucets in buildings under construction, the first embodiment (entitled 'potty blocker') by securing the toilet seat and toilet lid of a toilet in a fixed position relative to the toilet bowl and the second embodiment by creating a faucet and drain insert that are fixedly joined.

A (fixture) toilet use prevention system (a first embodiment) is disclosed herein, in a preferred embodiment, comprising: a clamping assembly comprising in combination an L-shape lid retainer, a J-shape bowl clamp, and a locking mechanism.

The L-shape lid retainer comprises in combination a retainer top portion having a top-surface and a bottom-surface. The L-shape lid retainer further comprises a retainer front portion having a front-surface and a back-surface. The J-shape bowl clamp comprises in combination a clamp-top-portion having a clamp-upper-surface having a slot and a clamp-lower-surface. The J-shape bowl clamp also comprises a clamp-rear-portion having a clamp-front-surface and a clamp-back-surface. The J-shape bowl clamp further comprises a clamp-bottom-portion having a first surface and a second surface. The locking mechanism comprises in combination a lock-sleeve, a tumbler-housing, and a tumbler with a key slot. The tumbler is housed within the tumbler-housing such that the key slot is accessible through the tumbler housing to manipulate the locking mechanism between locked and unlocked conditions. The locking mechanism is able to be locked and unlocked with a key placed into the key slot of the tumbler and turned.

The clamping assembly is preferably comprised of a flat metal bar. The retainer-top-portion of the L-shape lid retainer meets the retainer front portion of the L-shape lid retainer at a perpendicular bend to form an L-shape lid retainer. The clamp-top-portion of the J-shape bowl clamp meets the clamp-rear-portion of the J-shape bowl clamp forming a downward right angle bend and meets the clamp-bottom-portion forming the J-shape bowl clamp. The J-shape bowl clamp is wider than the L-shape lid retainer such that the retainer front portion of the L-shape lid retainer is able to slide through the slot of the clamp-top-portion of the J-shape bowl clamp to form a coupling of the L-shape lid retainer and the J-shape bowl clamp such that the clamping assembly is able to be coupled and locked.

The clamping assembly is attachable to a toilet bowl using the L-shape lid retainer and the J-shape bowl clamp. The J-shape bowl clamp is placed below the toilet lid and the seat of a toilet; the clamp-upper-surface being adjacent to the seat of the toilet. The length of the clamp-top-portion of the J-shape bowl clamp is of sufficient length to have the clamp-rear-portion seated adjacent the lip of the toilet bowl in use such that the clamp-top-portion extends beyond the front of the retainer front portion of the L-shape lid retainer when it is placed. The clamp-rear-portion of the J-shape bowl clamp is of sufficient length to 'wrap around' the lip of the toilet bowl.

The L-shape lid retainer is placed above the toilet lid such that the bottom-surface is adjacent the toilet lid (while system is in use). The L-shape lid retainer is placed such that the back-surface of the retainer front portion of the L-shape lid retainer is adjacent the front of the toilet bowl in use. The retainer top portion of the L-shape lid retainer is of sufficient length to extend over the toilet lid.

The retainer top portion of the L-shape lid retainer is substantially parallel to the clamp-top-portion of the J-shape bowl clamp when in use, the L-shape lid retainer maintaining a position above the toilet lid (and seat) and the J-shape bowl clamp below the toilet lid (and seat), the toilet lid (and seat) sandwiched between and held in place because the J shape bowl clamp is coupled to the rim of the toilet bowl. The L-shape lid retainer and the J-shape bowl clamp are separated by a sufficient distance to restrict the toilet lid and the toilet seat from movement apart from each other so that the toilet lid cannot be fully opened. The retainer front portion of the L-shape lid retainer is of sufficient length going down the front of the toilet bowl to prevent the toilet lid from being opened in relation to the toilet bowl. The J-shape bowl clamp fits adjacent and under the lip of the toilet bowl of the toilet such that the J-shape bowl clamp fixes the clamping assembly to the toilet bowl so that the toilet may be prevented from use (because the toilet lid can't be opened to access the bowl).

The clamping assembly when placed on a toilet is able to be locked in place to the toilet bowl using the locking mechanism to couple the L-shape lid retainer to the J-shape bowl clamp. The locking mechanism of the clamping assembly is attached to the retainer front portion of the L-shape lid retainer at a position to limit movement of the retainer front portion to prevent relative movement between the L-shape lid retainer and the J-shape bowl clamp which prevents the toilet lid from being opened for use of the toilet. The locking mechanism is able to be installed and removed at will via sliding the retainer front portion of the L-shape lid retainer through the lock sleeve of the locking mechanism.

A method of use for the first embodiment is disclosed herein, as is a second embodiment for use with faucets on tubs, and sinks. Kits for both embodiments may be produced and sold.

The present invention holds significant improvements and serves as a fixture (including toilet and faucet) use prevention system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, fixture use prevention system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a device for temporarily disenabling the use of toilets and faucets and more particularly to a fixture use prevention system as used to improve the capability to prevent the use of newly placed toilets in buildings under construction by securing the toilet seat and toilet lid of a toilet in a fixed position relative to the toilet bowl. Other fixtures may also be prevented from use via alternate embodiments.

Generally speaking, when buildings are under construction, bathroom appliances such as toilets are placed within a bathroom awaiting final installation. Thus, the toilet is available for improper use since the plumbing installation work hasn't been completed. The improper use may range from workers using the toilet facilities for its intended purpose as well as using the toilet as a dumping site for unused materials such as extra paint, concrete and so forth. As mentioned, this is undesirable.

To respond to this need the toilet (fixture) use prevention system provides an apparatus and system to secure bathroom toilets in buildings under construction using a clamping assembly having an L-shape lid retainer to hold a toilet seat and toilet lid in a fixed position when the L-shape lid retainer is used in conjunction with a J-shape bowl clamp. The clamping assembly is able to be locked using a locking mechanism that can be locked when the clamping assembly is being used to secure the toilet and unlocked when the toilet needs to be available to other workers, such as plumbers, to complete the assembly and installation of the toilet and fixtures.

Figure 1A:
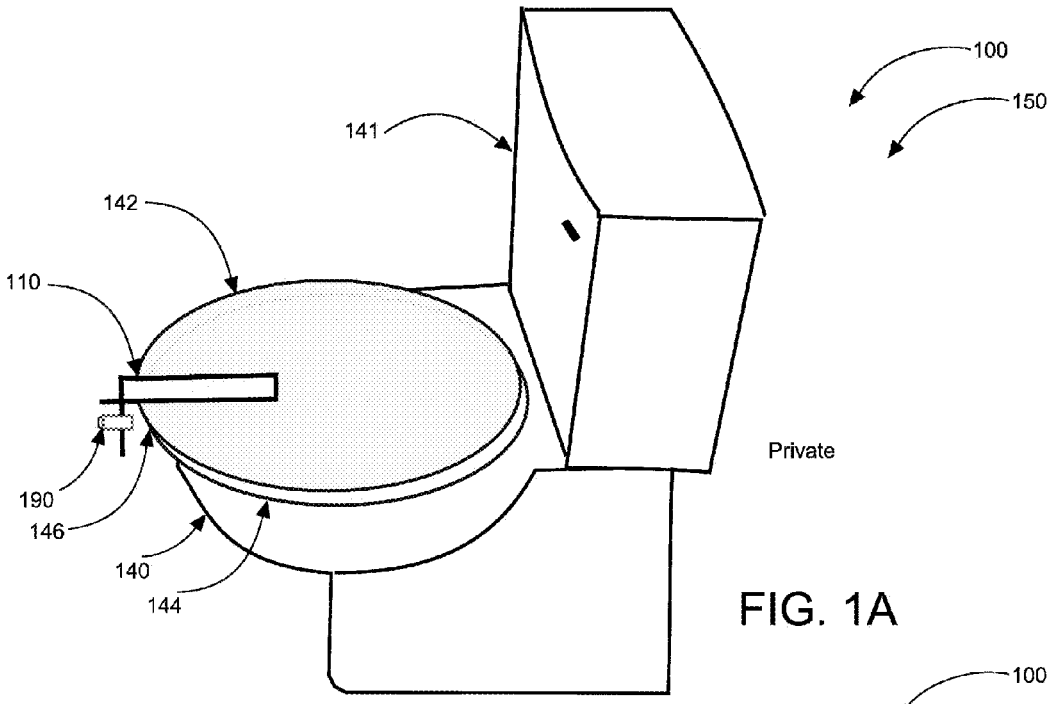
FIG. 1A shows a perspective view illustrating a toilet use prevention system in an in-use condition as used on a private (residential) toilet according to an embodiment of the present invention.
Figure 1B:
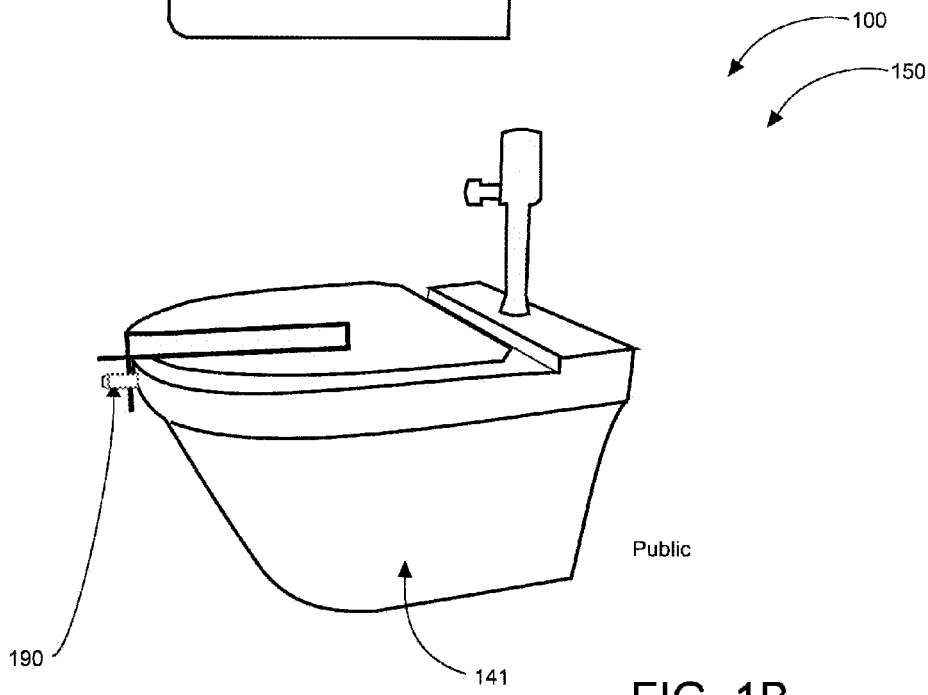
FIG. 1B shows a perspective view illustrating the toilet use prevention system in an in-use condition as used on a public (non-residential) toilet according to an embodiment of the present invention.

Referring now to the drawings by numerals of reference there is shown in FIGS. 1A and 1B, perspective views illustrating toilet use prevention system 100 in an in-use condition 150 according to an embodiment of the present invention. The present invention as such may be used on private and/or public toilets 141.

Figure 2:
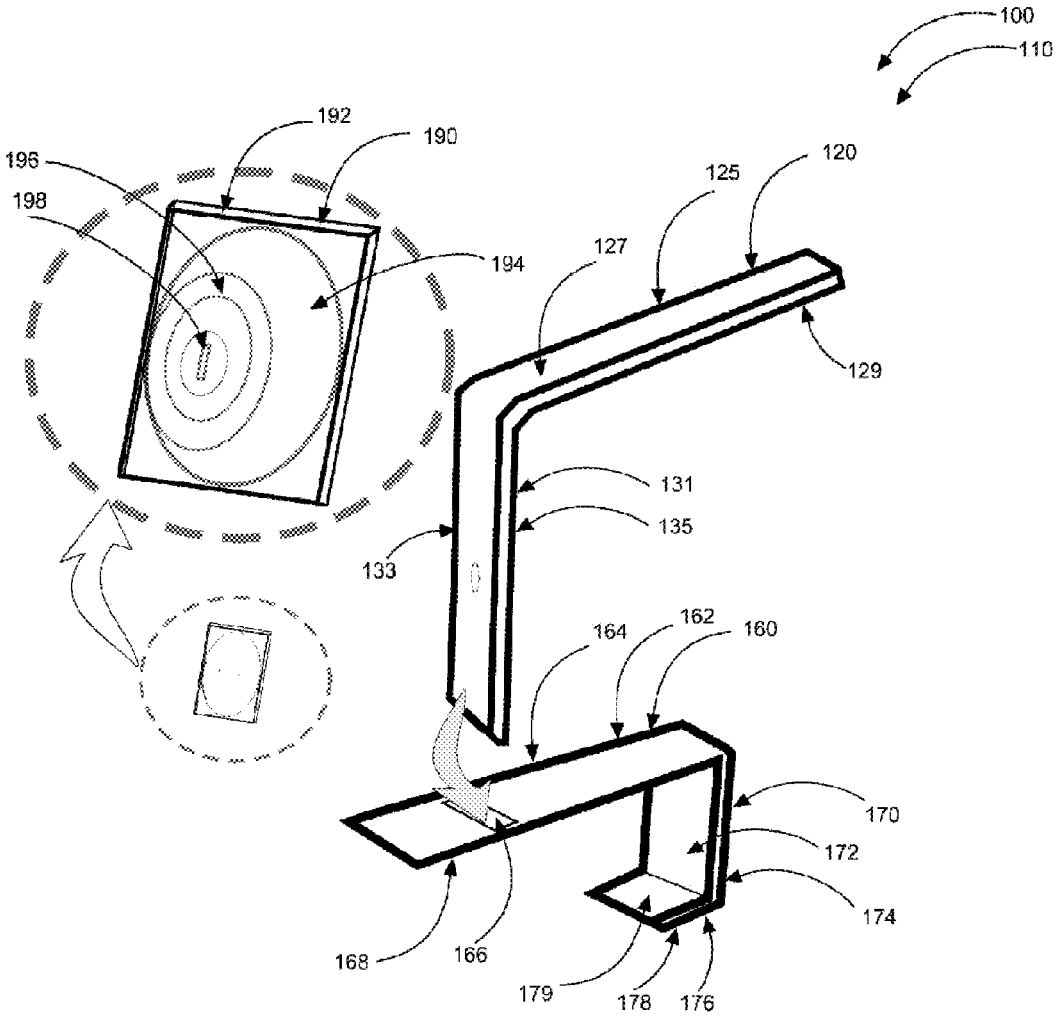
FIG. 2 is a perspective view illustrating various components of a clamping assembly according to an embodiment of the present invention of FIG. 1A.
Figure 3:
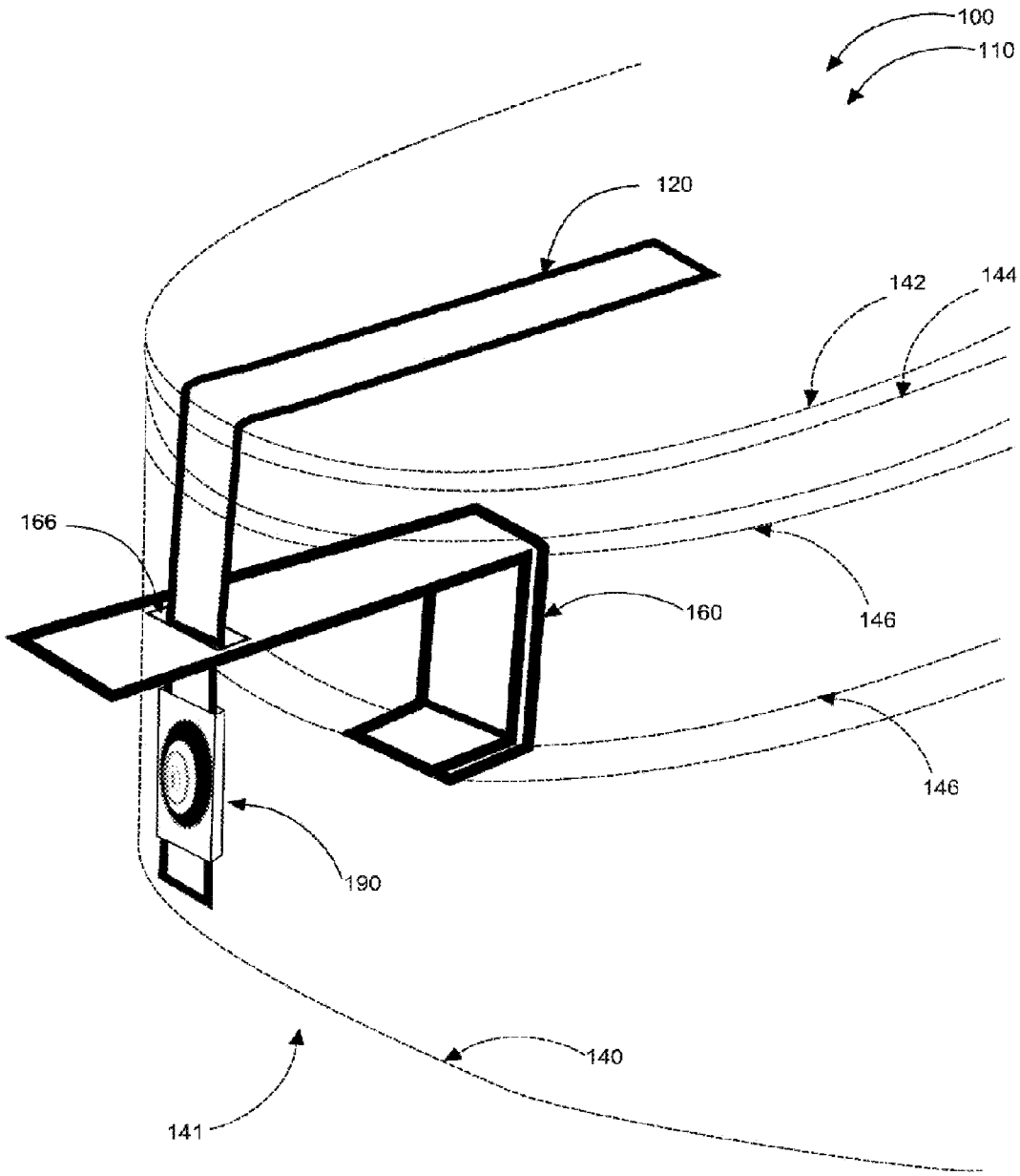
FIG. 3 is a perspective view illustrating an assembled clamping assembly according to an embodiment of the present invention of FIG. 1A.

Toilet use prevention system 100, in a preferred embodiment comprises: clamping assembly 110 comprising in combination L-shape lid retainer 120, J-shape bowl clamp 160, and locking mechanism 190, as also shown in FIGS. 2 and 3.

L-shape lid retainer 120 comprises retainer top portion 125 having top-surface 127 and bottom-surface 129. L-shape lid retainer 120 further comprises retainer front portion 131 having front-surface 133 and back-surface 135.

J-shape bowl clamp 160 comprises clamp-top-portion 162 having clamp-upper-surface 164 having slot 166 and clamp-lower-surface 168. J-shape bowl clamp 160 also comprises clamp-rear-portion 170 having clamp-front-surface 172 and clamp-back-surface 174. J-shape bowl clamp 160 further comprises clamp-bottom-portion 176 having first surface 178 and second surface 179.

Locking mechanism 190 comprises in combination lock-sleeve 192, tumbler-housing 194, and tumbler 196 with key slot 198. Tumbler 196 is housed within tumbler-housing 194 such that key slot 198 is accessible through tumbler housing 194 to manipulate locking mechanism 190 between locked and unlocked conditions. Locking mechanism 190 is able to be locked and unlocked with a key placed into key slot 198 of the tumbler 196 and turned. Locking mechanism 190 is able to be moved up and down on front portion 131 via lock-sleeve 192. In this way the present invention may be locked and unlocked as desired.

Referring now to FIG. 2, a perspective view illustrating various components of clamping assembly 110 according to an embodiment of the present invention of FIG. 1A.

Clamping assembly 110 is preferably comprised of a flat metal bar for temporary use when it is understood that toilet 141 needs to be secured for a relatively short period of time. Another embodiment provides for clamping assembly 110 comprising a flat plastic bar if clamping assembly 110 will be left on toilet 141 for a longer period of time. The plastic version is less abrasive to the finished surface of the toilet installation. Locking mechanism 190 may be installed through aperture as shown in dashed lines or locking mechanism 190 may friction against L-shape lid retainer 120.

Retainer-top-portion 125 of L-shape lid retainer 120 meets retainer front portion 131 of L-shape lid retainer 120 at a perpendicular bend to form L-shape lid retainer 120. Clamp-top-portion 162 of J-shape bowl clamp 160 meets clamp-rear-portion 170 of J-shape bowl clamp 160 forming a downward right angle bend and meets clamp-bottom-portion 176 forming J-shape bowl clamp 160. J-shape bowl clamp 160 is wider than L-shape lid retainer 120 such that retainer front portion 131 of L-shape lid retainer 120 is able to slide through slot 166 of clamp-top-portion 162 of J-shape bowl clamp 160 to form a coupling of L-shape lid retainer 120 and J-shape bowl clamp 160 such that clamping assembly 110 is able to be locked in a coupled condition.

Clamping assembly 110 is attachable to toilet bowl 140 using L-shape lid retainer 120 and J-shape bowl clamp 160. J-shape bowl clamp 160 is placed below toilet lid 142 and seat 144 of toilet 141 with clamp-upper-surface 164 being adjacent to seat 144 of toilet 141. The length of clamp-top-portion 162 of J-shape bowl clamp 160 is of sufficient length to have clamp-rear-portion 170 seated adjacent lip 146 of toilet bowl 140 in use such that clamp-top-portion 162 extends beyond the front of retainer front portion 131 of L-shape lid retainer 120 when it is placed. Clamp-rear-portion 170 of J-shape bowl clamp 160 is of sufficient length to wrap around lip 146 of toilet bowl 140 such that it is able to be coupled thereto.

Referring now to FIG. 3, a perspective view illustrating assembled clamping assembly 110 as mounted on toilet 141 (shown in dashed lines) according to an embodiment of the present invention of FIG. 1A.

L-shape lid retainer 120 is placed above toilet lid 142 such that bottom-surface 129 of retainer top portion 125 is adjacent toilet lid 142 in use. L-shape lid retainer 120 is placed such that back-surface 135 of retainer front portion 131 of L-shape lid retainer 120 is adjacent the front of toilet bowl 140 in use. Retainer top portion 125 of L-shape lid retainer 120 is of sufficient length to extend over toilet lid 142.

Retainer top portion 125 of L-shape lid retainer 120 is substantially parallel to clamp-top-portion 162 of J-shape bowl clamp 160 when in use. L-shape lid retainer 120 and J-shape bowl clamp 160 are separated by a sufficient distance to restrict toilet lid 142 of toilet 141 and seat 144 of toilet 141 from movement apart from each other so toilet lid 142 cannot be fully opened, as shown in FIGS. 1A and 1B. Retainer front portion 131 of L-shape lid retainer 120 is of sufficient length going down the front of toilet bowl 140 to prevent toilet lid 142 of toilet 141 from being opened in relation to toilet bowl 140, when removed toilet 141 is able to be maintained and function for regular use. When locked, J-shape bowl clamp 120 fits adjacent and under lip 146 of toilet bowl 140 of toilet 141 such that J-shape bowl clamp 160 fixes clamping assembly 110 to toilet bowl 140 so that toilet 141 may be prevented from use. J-shape bowl clamp 120 and/or L-shape lid retainer 120 may be longer (as in FIG. 1B) or shorter as in FIGS. 1A and 2-3.

Clamping assembly 110 when placed on toilet 141 is able to be locked in place to toilet bowl 140 using locking mechanism 190 to couple L-shape lid retainer 120 to J-shape bowl clamp 160. Locking mechanism 190 of clamping assembly 110 is attached to retainer front portion 131 of L-shape lid retainer 120 at a position to limit movement of retainer front portion 131 to prevent relative movement between L-shape lid retainer 120 and J-shape bowl clamp 160 which prevents toilet lid 142 from being opened for use of toilet 141. Locking mechanism 190 is able to be installed and removed at will via sliding retainer front portion 131 of L-shape lid retainer 120 being inserted through lock sleeve 192 of locking mechanism 190 and locked in place.

Clamping assembly 110 of toilet use prevention system 100 comprises a kit having L-shape lid retainer 120, J-shape bowl clamp 160 and locking mechanism 190 with a set of user instructions.

Figure 4:
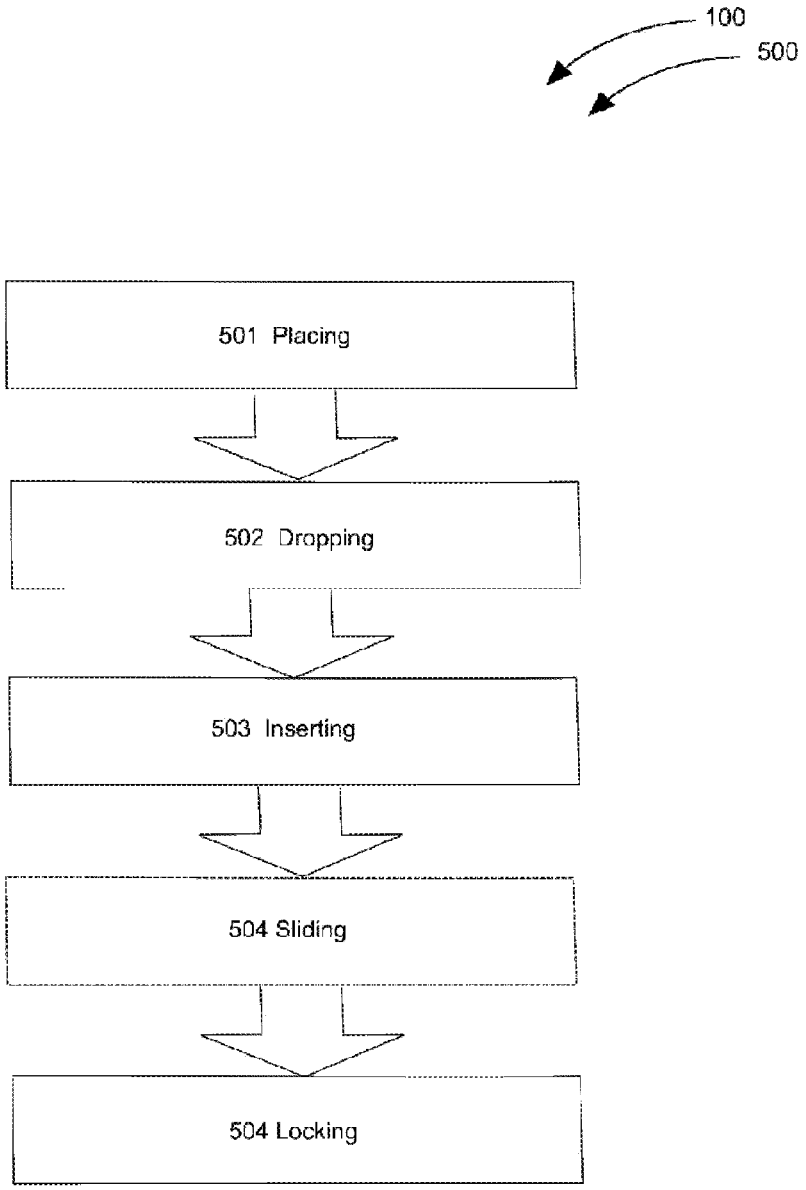
FIG. 4 is a flowchart illustrating a method of use of a toilet use prevention system according to an embodiment of the present invention of FIGS. 1A-3

Referring now to FIG. 4, a flowchart illustrating a method of use 500 of toilet use prevention system 100 according to an embodiment of the present invention of FIGS. 1A-3.

A method of use 500 for toilet use prevention system 100 preferably comprises the steps of: step one 501 placing J-shape bowl clamp 160 on to lip 146 of toilet bowl 140; step two 502 dropping seat 144 and toilet lid 142 to a position adjacent toilet bowl 140; step three 503 inserting retainer front portion 131 of L-shape lid retainer 120 through slot 166 in clamp-top-portion 162 of J-shape bowl clamp 160 and sliding retainer front portion 131 downwardly thereby coupling L-shape lid retainer 120 and J-shape bowl clamp 160 to toilet 141 via lip 146 of toilet bowl 140 (L-shape lid retainer 120 located above seat 144 and toilet lid 142); step four 504 sliding locking mechanism 190 onto retainer front portion 131 to secure clamping assembly 110 to toilet bowl 140 to prevent use of toilet bowl 140 by restricting movement of toilet lid 142 in relation to toilet bowl 140; and step five 505 locking locking mechanism 190 to prevent use of toilet 141.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

Figure 5:
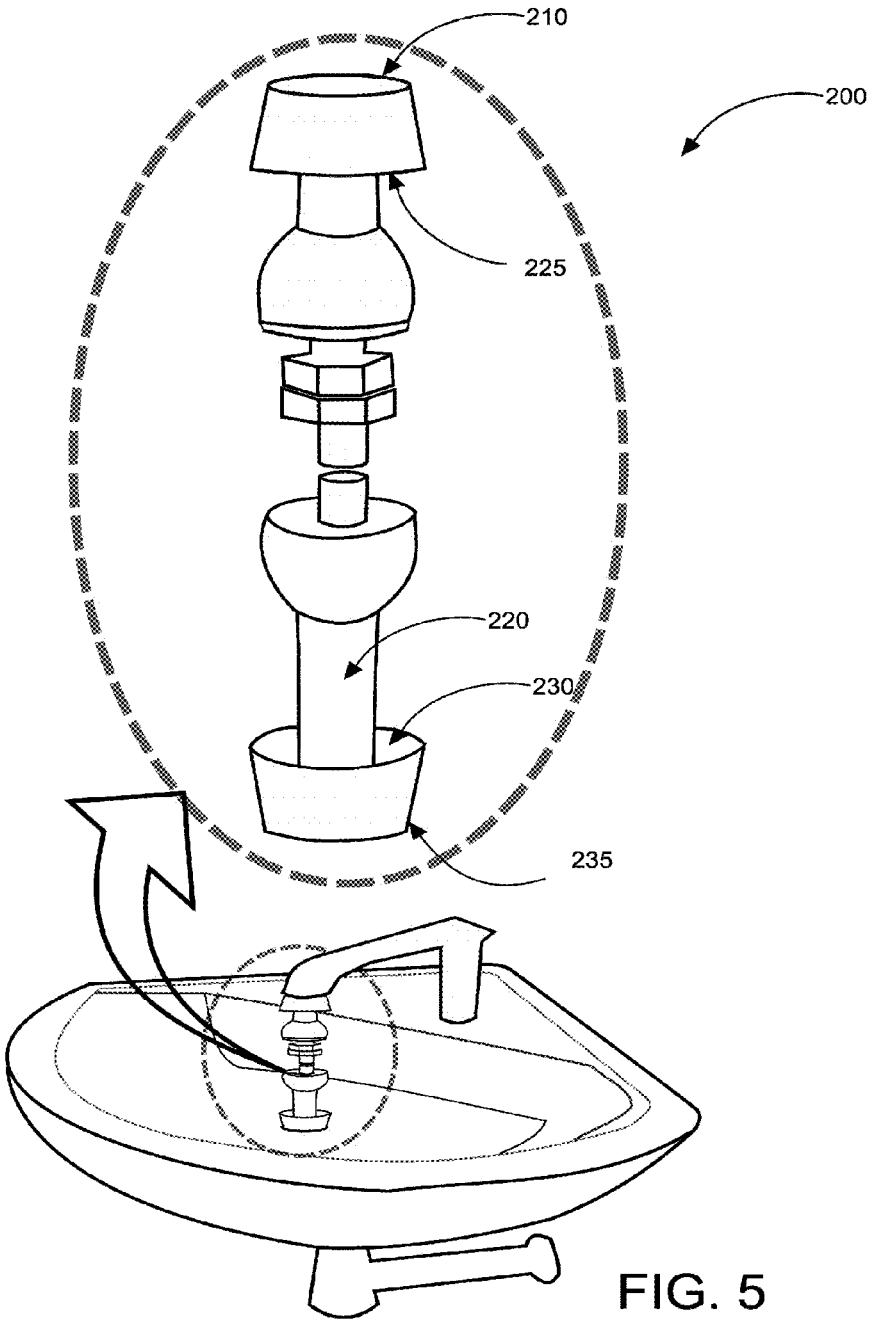
FIG. 5 is a perspective view illustrating a faucet and drain stopper (fixture use prevention) according to an alternate embodiment of the present invention.

Referring now to FIG. 5, a perspective view illustrating a (fixture) faucet stopper 200 according to an alternate embodiment of the present invention.

An alternate embodiment of the present invention is faucet stopper 200 comprising faucet insert 210, separation extension 220 having first end 225, second end 230 and drain insert 235. Faucet insert 210 is inserted in faucet opening 215 and drain insert is inserted in drain opening of a sink (as shown) or tub. This particular embodiment prevents use of sinks and tubs when it is not desired that they be used. Faucet stopper 200 comprises a kit having faucet insert 210, separation extension 220, and drain insert 235 with a set of user instructions.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A toilet use prevention system comprising:
- a clamping assembly comprising;
  - an L-shape lid retainer having;
    - a retainer top portion comprising;
      - a top-surface; and
      - a bottom-surface;
    - a retainer front portion comprising;
      - a front-surface; and
      - a back-surface;
  - a J-shape bowl clamp comprising;
    - a clamp-top-portion comprising;
      - a clamp-upper-surface having a slot; and
      - a clamp-lower-surface;
    - a clamp-rear-portion comprising;
      - a clamp-front-surface; and
      - a clamp-back-surface;
    - a clamp-bottom-portion comprising;
      - a first surface; and
      - a second surface;
  - a locking mechanism comprising;
    - a lock-sleeve;
    - a tumbler-housing; and
    - a tumbler with key slot;
- wherein said toilet use prevention system comprises said clamping assembly;
- wherein said clamping assembly comprising in combination said L-shape lid retainer, said J-shape bowl clamp, and said locking mechanism;
- wherein said L-shape lid retainer comprises in combination said retainer top portion, and said retainer front portion;
- wherein said retainer top portion comprises said top-surface and said bottom-surface;
- wherein said retainer front portion comprises said front-surface and said back-surface;
- wherein said J-shape bowl clamp comprises said clamp-top-portion, said clamp-rear-portion, and said clamp-bottom-portion;
- wherein said clamp-top-portion comprises said clamp-upper-surface and said clamp-lower-surface;
- wherein said clamp-rear-portion comprises said clamp-front-surface and said clamp-back-surface;
- wherein said clamp-bottom-portion comprises said first surface and said second surface;
- wherein said locking mechanism comprises in combination said lock-sleeve, said tumbler-housing, and said tumbler with said key slot;
- wherein said tumbler is housed within said tumbler-housing such that said key slot is accessible through said tumbler housing to manipulate said locking mechanism between locked and unlocked conditions;
- wherein said J-shape bowl clamp is wider than said L-shape lid retainer;
- wherein said retainer-top-portion of said L-shape lid retainer meets said retainer front portion of said L-shape lid retainer at a perpendicular bend to form said L-shape lid retainer;
- wherein where said clamp-top-portion of said J-shape bowl clamp meets said clamp-rear-portion of said J-shape bowl clamp forming a downward right angle bend and meets said clamp-bottom-portion forming said J-shape bowl clamp;
- wherein said retainer front portion of said L-shape lid retainer is able to slide through said slot of said clamp-top-portion of said J-shape bowl clamp to form a coupling of said L-shape lid retainer and said J-shape bowl clamp such that said clamping assembly is able to be locked with said locking mechanism;
- wherein said clamping assembly is attachable to a toilet bowl using said L-shape lid retainer and said J-shape bowl clamp;
- wherein said clamping assembly is able to be locked in place to said toilet bowl using said locking mechanism to couple said L-shape lid retainer to said J-shape bowl clamp, said locking mechanism able to be installed and removed at will via sliding said retainer front portion through said lock sleeve of said locking mechanism; and
- wherein said J-shape bowl clamp fits adjacent and under a lip of said toilet bowl of a toilet such that said J-shape bowl clamp fixes said clamping assembly to said toilet bowl so that said toilet may be prevented from use.

2. The toilet use prevention system of claim 1 wherein said retainer top portion of said L-shape lid retainer is parallel to said clamp-top-portion of said J-shape bowl clamp in use.

3. The toilet use prevention system of claim 1 wherein said retainer top portion of said L-shape lid retainer is of sufficient length to extend over a toilet lid.

4. The toilet use prevention system of claim 3 wherein said retainer front portion of said L-shape lid retainer is of sufficient length going down a front of said toilet bowl to prevent said toilet lid from being opened in relation to said toilet bowl.

5. The toilet use prevention system of claim 3 wherein a length of said clamp-top-portion of said J-shape bowl clamp is of sufficient length to have said clamp-rear-portion seated adjacent said lip of said toilet bowl in use and said clamp-top-portion extends beyond front of said retainer front portion and of said toilet bowl.

6. The toilet use prevention system of claim 5 wherein said clamp-rear-portion of said J-shape bowl clamp is of sufficient length to wrap around an inside of said lip of said toilet bowl.

7. The toilet use prevention system of claim 5 wherein said retainer top portion of said L-shape lid retainer is placed above said toilet lid, said bottom-surface adjacent said toilet lid in use.

8. The toilet use prevention system of claim 1 wherein said locking mechanism of said clamping assembly is attached to said retainer front portion to prevent relative movement between said L-shape lid retainer and said J-shape bowl clamp.

9. The toilet use prevention system of claim 8 wherein said locking mechanism of said clamping assembly is attached to said retainer front portion at a position to limit movement of said retainer front portion to prevent said toilet lid from being opened for use of said toilet.

10. The toilet use prevention system of claim 8 wherein said J-shape bowl clamp is placed below said toilet lid and a seat of said toilet, said clamp-upper-surface adjacent said toilet lid in use.

11. The toilet use prevention system of claim 1 wherein said clamping assembly is plastic.

12. The toilet use prevention system of claim 11 wherein said L-shape lid retainer is placed such that said back-surface of said retainer front portion of said L-shape lid retainer is adjacent a front of said toilet bowl in use.

13. The toilet use prevention system of claim 12 wherein said locking mechanism is able to be locked and unlocked with a key placed into said key slot of said tumbler and turned.

14. The toilet use prevention system of claim 13 wherein said locking mechanism is attached to said retainer front portion of said L-shape lid retainer.

15. The toilet use prevention system of claim 13 wherein said locking mechanism is attached through an aperture located in said retainer front portion of said L-shape lid retainer.

16. The toilet use prevention system of claim 15 wherein said L-shape lid retainer and said J-shape bowl clamp are separated by a sufficient distance to restrict said toilet lid and said seat of said toilet from movement apart from each other so that said toilet lid cannot be fully opened.

17. The toilet use prevention system of claim 16 wherein said clamping assembly comprises a kit having said L-shape lid retainer, said J-shape bowl clamp and said locking mechanism with a set of user instructions.

18. The toilet use prevention system of claim 15 wherein said clamping assembly is comprised of flat bar.

19. A toilet use prevention system comprising:

a clamping assembly comprising;
- an L-shape lid retainer having;
  - a retainer top portion comprising;
    - a top-surface; and
    - a bottom-surface;
  - a retainer front portion comprising;
    - a front-surface; and
    - a back-surface;
- a J-shape bowl clamp comprising;
  - a clamp-top-portion comprising;
    - a clamp-upper-surface having a slot; and
    - a clamp-lower-surface;
  - a clamp-rear-portion comprising;
    - a clamp-front-surface; and
    - a clamp-back-surface;
  - a clamp-bottom-portion comprising;
    - a first surface; and
    - a second surface;
- a locking mechanism comprising;
  - a lock-sleeve;
  - a tumbler-housing; and
  - a tumbler with a key slot;

wherein said toilet use prevention system comprises said clamping assembly;

wherein said clamping assembly is comprised of flat bar;

wherein said clamping assembly is metal;

wherein said clamping assembly comprises in combination said L-shape lid retainer, said J-shape bowl clamp, and said locking mechanism;

wherein said L-shape lid retainer comprises in combination said retainer top portion, and said retainer front portion;

wherein said retainer top portion comprises said top-surface and said bottom-surface;

wherein said retainer-top-portion of said L-shape lid retainer meets said retainer front portion of said L-shape lid retainer at a perpendicular bend to form said L-shape lid retainer;

wherein said retainer front portion of said L-shape lid retainer is able to slide through said slot of said clamp-top-portion of said J-shape bowl clamp to form a coupling of said L-shape lid retainer and said J-shape bowl clamp such that said clamping assembly is able to be locked;

wherein said retainer top portion of said L-shape lid retainer is parallel to said clamp-top-portion of said J-shape bowl clamp in use;

wherein said retainer top portion of said L-shape lid retainer is placed above said toilet lid, said bottom-surface adjacent said toilet lid in use;

wherein said J-shape bowl clamp is placed below said toilet lid and said seat of said toilet, said clamp-upper-surface adjacent said seat of said toilet in use;

wherein said L-shape lid retainer and said J-shape bowl clamp are separated by a sufficient distance so to restrict said toilet lid and said toilet seat from movement apart from each other so that said toilet lid cannot be fully opened;

wherein said retainer top portion of said L-shape lid retainer is of sufficient length to extend over said toilet lid;

wherein said L-shape lid retainer is placed such that said back-surface of said retainer front portion of said L-shape lid retainer is adjacent a front of said toilet bowl in use;

wherein said retainer front portion of said L-shape lid retainer is of sufficient length going down said front of said toilet bowl to prevent said toilet lid from being opened in relation to said toilet bowl;

wherein said clamping assembly is attachable to said toilet bowl using said L-shape lid retainer and said J-shape bowl clamp;

wherein said retainer front portion comprises said front-surface and said back-surface;

wherein said J-shape bowl clamp comprises said clamp-top-portion, said clamp-rear-portion, and said clamp-bottom-portion;

wherein said J-shape bowl clamp is wider than said L-shape lid retainer;

wherein said clamp-top-portion comprises said clamp-upper-surface and said clamp-lower-surface;

wherein where said clamp-top-portion of said J-shape bowl clamp meets said clamp-rear-portion of said J-shape bowl clamp forming a downward right angle bend and meets said clamp-bottom-portion forming said J-shape bowl clamp;

wherein a length of said clamp-top-portion of said J-shape bowl clamp is of sufficient length to have said clamp-rear-portion seated adjacent said lip of said toilet bowl in use and said clamp-top-portion extend beyond front of said retainer front portion and of said toilet bowl;

wherein said clamp-rear-portion comprises said clamp-front-surface and said clamp-back-surface;

wherein said clamp-bottom-portion comprises said first surface and said second surface;

wherein said clamp-rear-portion of said J-shape bowl clamp is of sufficient length to wrap around said lip of said toilet bowl;

wherein said clamping assembly is able to be locked in place to said toilet bowl using said locking mechanism to couple said L-shape lid retainer to said J-shape bowl clamp, said locking mechanism able to be installed and removed at will via sliding said retainer front portion through said lock sleeve of said locking mechanism;

wherein said locking mechanism comprises in combination said lock-sleeve, said tumbler-housing, and said tumbler with key slot;

wherein said locking mechanism of said clamping assembly is attached to said retainer front portion to prevent relative movement between said L-shape lid retainer and said J-shape bowl clamp;

wherein said locking mechanism is attached to said retainer front portion of said L-shape lid retainer;

wherein said locking mechanism of said clamping assembly is attached to said retainer front portion at a position to limit movement of said retainer front portion to prevent said toilet lid from being opened for use of said toilet;

wherein said locking mechanism is able to be locked and unlocked with a key placed into said key slot of said tumbler and turned;

wherein said tumbler is housed within said tumbler-housing such that said key slot is accessible through said tumbler housing to manipulate said locking mechanism between locked and unlocked conditions; and wherein said J-shape bowl clamp fits adjacent and under said lip of said toilet bowl of said toilet such that said J-shape bowl clamp fixes said clamping assembly to said toilet bowl so that said toilet may be prevented from use.

* * * * *